United States Patent [19]

Fujimaki

[11] Patent Number: 4,941,857

[45] Date of Patent: Jul. 17, 1990

[54] ANIMAL TOYS HAVING SWITCH AND VIBRATION MOTOR

[75] Inventor: Hiroaki Fujimaki, Tokyo, Japan

[73] Assignee: Tomy Kogyo Co., Inc., Tokyo, Japan

[21] Appl. No.: 375,924

[22] Filed: Jul. 6, 1989

Related U.S. Application Data

[63] Continuation of Ser. No. 192,612, May 11, 1988, Pat. No. 4,867,726.

[30] Foreign Application Priority Data

Aug. 27, 1987 [JP] Japan ..... 62-130857
Sep. 10, 1987 [JP] Japan ..... 62-138429

[51] Int. Cl.[5] ..... A63H 11/02
[52] U.S. Cl. ..... 446/353
[58] Field of Search ..... 446/297, 303, 175, 484, 446/353, 352, 354

[56] References Cited

U.S. PATENT DOCUMENTS

| | | | |
|---|---|---|---|
| 4,237,647 | 12/1980 | Shaw | 446/303 |
| 4,282,681 | 8/1981 | McCaslin | 446/484 |
| 4,314,423 | 2/1982 | Lipsitz et al. | 446/303 |
| 4,687,457 | 8/1987 | Milner | 446/175 |

FOREIGN PATENT DOCUMENTS

| | | | |
|---|---|---|---|
| 2254185 | 7/1975 | France | 446/484 |

*Primary Examiner*—Mickey Yu
*Attorney, Agent, or Firm*—Staas & Halsey

[57] ABSTRACT

Animal toys capable of electrically producing body movements are switched on and off by a pair of spaced apart electrical contacts disposed on a bottom surface of the animal toys. When a toy is placed in an individual's hand, the two contacts are bridged and an electrical circuit within the animal toy is closed to activate either a vibration producing mechanism.

5 Claims, 2 Drawing Sheets

ANIMAL TOYS HAVING SWITCH AND VIBRATION MOTOR

This is a continuation of co-pending application Ser. No. 07/192,612 filed on May 11, 1988, Pat. No. 4,867,726.

BACKGROUND OF THE INVENTION

1. Field of the Invention

The present invention relates generally to animal toys, and more specifically, to animal toys that simulate live animals by producing sound and/or movement.

2. Description of the Related Art

Conventional animals toys have sound making and/or body movement capabilities. For body movement, a battery powered motor drives an actuating mechanism which causes the body of the animal toy to move. Various forms of manually operated switches are used to turn on and off the actuating mechanism. These switches extend outwardly and protrusively from the main body of the animal toys in such a way as to detract from the aesthetically pleasing appearance of the animal toy. The various forms of known switches usually include a control knob which protrudes from the body of the animal toy.

Previously used sound making mechanisms are similarly switched in that they require obtrusive, outwardly extending, manually operated switches for activation.

Manually operated, protrusive switches present animal toys from appearing sufficiently life-like. Even if the switches were well hidden, they still must be manually manipulated by holding the toy in one hand and turning the switch with the other hand. Such manual operation further detracts from the life-like appearance of the animal toys. The obtrusive switch problem is more acute for diminutive animal toys, such as a mouse, squirrel, or bird.

SUMMARY OF THE INVENTION

An object of the invention is to provide an animal toy with an inconspicuous or completely obscured switch for turning on and off either a noise making mechanism or an actuating mechanism, or both.

Another object of the invention is to provide an animal toy which is capable of simulating life-like sounds and movements.

Yet another object of the invention is to provide a switch for an animal toy which is activated simply by picking up the animal toy and placing it on the palm of an individual's hand.

Another object of the invention is to provide an animal toy which is both aesthetically pleasing to the eye and mechanically functional to simulate life-like motions and/or sound.

These and other objects of the invention are met by providing an animal toy having a body shaped in the form of an animal, an electric circuit including a speaker, at least a portion of the electrical circuit being connected to the body, a pair of spaced apart contacts electrically connected to the electrical circuit, but electrically isolated from each other, and being disposed on an outer surface of the body, the electrical circuit being closable when the two contacts are touched simultaneously by a human hand.

Another embodiment of the invention provides an animal toy having a body shaped in the shape of an animal and having inner and outer surfaces, a movement mechanism disposed within the body for moving the body when activated, an electrical motor attached to the moving mechanism for actuating the moving mechanism, a control circuit electrically coupled to the electrical motor, a pair of spaced apart contacts electrically connected to the control circuit but isolated from each other, the control circuit being closable to switch on the movement mechanism when the pair of spaced apart contacts are touched simultaneously by a human hand.

The electrical circuit to which the contacts are connected in both embodiments, is closed by the palm or skin of a person after picking up the animal toy, the person's palm or skin bridges the gap between the two contacts such that when the circuit is closed, a drive motor incorporated inside the main body turns an actuating mechanism which vibrates the body, or a speaker produces sounds, or both.

These and other features and advantages of the animal toys of the present invention will become more apparent with reference to the following detailed description and drawings.

DETAILED DESCRIPTION OF THE DRAWINGS

Figure 1:
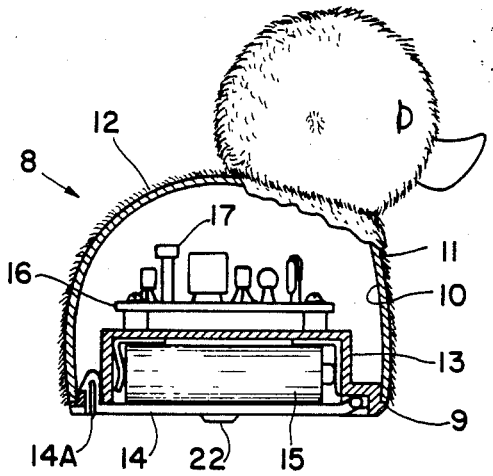
FIG. 1 is a right side view, partly in section, of a first preferred embodiment of the present invention.
Figure 2:
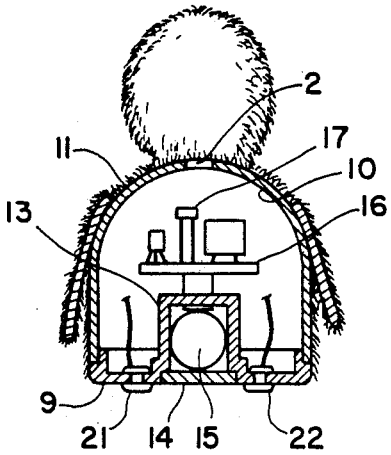
FIG. 2 is a rear view, partly in section, of the embodiment of FIG. 1.

Referring to FIGS. 1 and 2, an animal toy 8 has a body 10 which is made of a synthetic resin. A cloth outer covering 11 covers the body 10 to provide the look and feel of an animal. In the FIG. 1 embodiment, the animal is a bird and the cloth covering 11 is woven to carry hairs or other fine monofilament material to provide a feather-like appearance. Other suitable coverings may be employed.

An opening 12 is provided on the top of the body 10 so as to permit light to enter the interior of the body 10, and thereby strike the photosensor 17 (to be described later).

A bottom plate 9, which forms a lower part of the body 10, is received in the open bottom of the body 10 and is held in place by an interference fit between the lower edge of the body 10 and an upper edge of the bottom plate 9. The bottom plate 9 includes a battery receptacle 13 which is integrally formed with the bottom plate 9 as a medial recess. The battery receptacle 13 has an open top which is substantially coplanar with a bottom surface of the bottom plate 9 so as to permit installation and removal of a battery 15. The battery 15 provides a power source for the sound-making mechanism contained within the body 10. A cover 14 holds the battery 15 in the battery receptacle 13. As shown in FIG. 1, an end 14*a* of the cover 14 is pivotally connected to the bottom plate 9. The opposite end of the cover plate 14 is snap fitted into a recess provided in the bottom plate 9.

Figure 3:
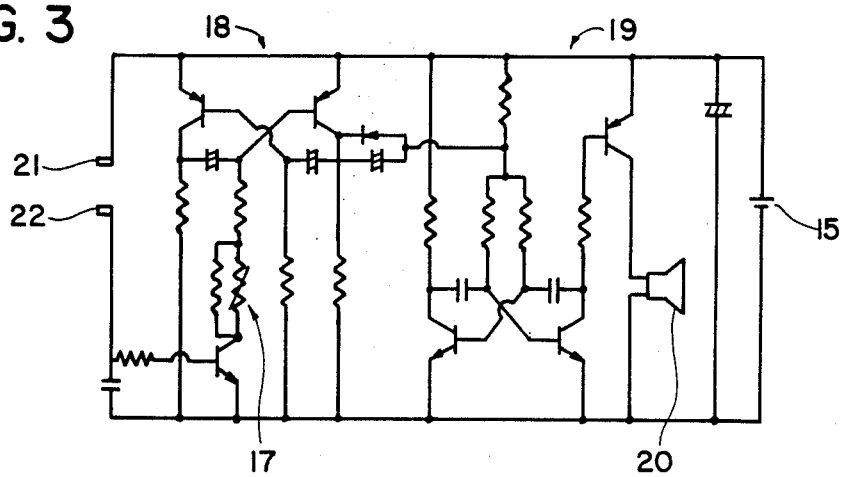
FIG. 3 is a circuit diagram for a circuit board incorporated in the FIG. 1 embodiment.

A circuit board 16 is mounted on top of the battery receptacle 13 by threaded fasteners. The circuit board 16 has an electrical circuit which includes a photosensor 17 which is disposed near the opening 12. The circuit diagram of the circuit board 16 is shown in FIG. 3. A sound producing mechanism, which for the embodiment of FIG. 1 would make the sound of a chirping bird, includes a first oscillator 18, a second oscillator 19 and a speaker 20. A pair of contacts 21 and 22 are incorporated in the circuit shown in FIG. 3. The contacts 21 and 22 are made of a conductive material and are spaced apart as shown in FIG. 2. The contacts 21 and 22 are unobtrusive and are nearly flush with the bottom of the bottom plate 9, which is preferably not covered with the outer covering 11. The noise making mechanism, which includes the two oscillators 18 and 19 and the speaker 20, is activated by electrically bridging the gap between the contacts 21 and 22. When the gap is bridged, current from the battery 15 flows through the circuit, but not enough flows between the two contacts to cause an electrical shock for the person touching the contacts.

The photosensor 17 includes a photosensitive material such as cadmium sulfide (CdS) which has a variable resistance depending on the presence or absence of light. The photosensor 17 is installed on top of the circuit board 16 beneath the opening 12 and in proximity thereto.

When the animal toy 8 is placed in the palm of an individual's hand, the contacts 21 and 22 are bridged by the moist skin of the palm. The open circuit becomes closed and the sound making mechanism is activated to produce a chirping sound.

Figure 4A:
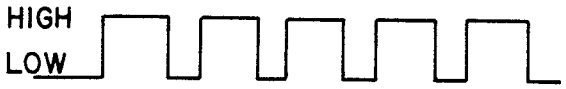
FIGS. 4*a* and 4*b* are wave forms generated by the FIG. 3 circuit.

Contacts 21 and 22 function as a touch sensor. The oscillator 8 outputs an intermittent high frequency signal as illustrated in FIG. 4*a* when the contacts 21 and 22 are closed. The signal produced by oscillator 18 is intermittent at a predetermined interval. The oscillator 19, which is connected in the circuit to oscillator 18, outputs a signal corresponding to the basic frequency of a bird's chirping sound. The speaker 10 produces a "chirp" sound when the output signal of oscillator 18 is at a high level.

Figure 4B:
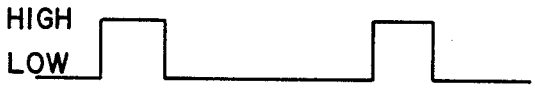

The photosensor 17 is not a necessary part of the sound producing mechanism of the present invention. However, with the addition of the photosensor 17, the absence of light passing through the opening 12 can be detected by the photosensor 17 such as when the opening 12 is shielded when the animal toy 8 is petted or rubbed. When the opening 12 is covered, the resistance value of the photosensitive material of the photosensor 17 changes and the interval between high levels of the oscillator 18 becomes longer, as shown in FIG. 4*b*. Therefore, the interval between "chirp" sounds of the sound producing mechanism incorporated inside the body becomes longer. The effect is to simulate the sound of a bird chirping more slowly, which would result from the bird being petted.

As a result of the contacts 21 and 22, the animal toy shown in FIGS. 1 and 2 requires no special switch control or protrusive control knobs. The animal toy requires nothing more than that the toy be placed in the palm of someone's hand. This has the effect of creating a more life-like appearance.

Figure 5:
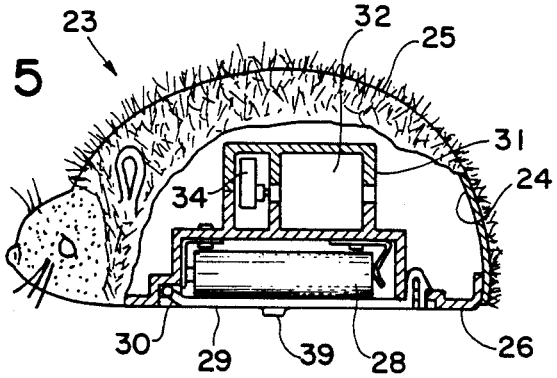
FIG. 5 is a left side view, partly in section, of a second preferred embodiment of the present invention.
Figure 6:
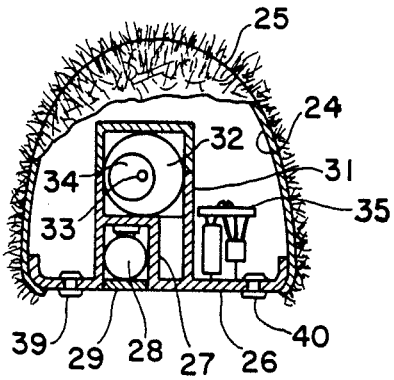
FIG. 6 is a rear view, partly in section, of the embodiment of FIG. 5.
Figure 7:
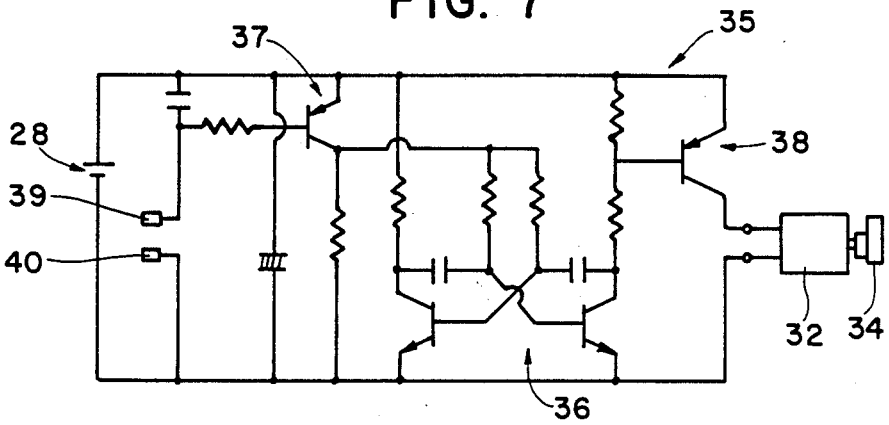
FIG. 7 is a circuit diagram for a circuit board incorporated in the FIG. 5 embodiment.

A second preferred embodiment of the present invention is illustrated in FIGS. 5–7. An animal toy 23 has a body 24 which is made of a synthetic resin. A cloth outer covering 25 covers the body 24 to provide the look and feel of an animal. In the FIG. 5 embodiment, the animal is a mouse and the cloth covering 25 is woven to carry hairs or other fine monofilament material to provide a thin fur-like appearance. Other suitable materials may be employed. A bottom plate 26 fits into an open bottom of the body 24 to complete the body of the animal. The bottom plate 26 is held in place by an interference fit with the lower edge rim of the body 24. The interior of the body 24 is hollow to accommodate the movement mechanism to be described below.

The bottom plate 26 has an integrally formed battery receptacle 27 which houses battery 28. Battery 28 provides a power source for the movement mechanism. A battery cover 29 is used to cover the open end of the battery receptacle 27 and is substantially coplanar with the bottom of the bottom plate 26. The cover 29 has one end 30 pivotally connected to the bottom plate 26 so that the battery receptacle 27 can be easily opened and closed to install and remove a battery 28. The opposite end of the lever 29 is snap fitted or otherwise detachably connected to the bottom plate 26.

A frame 31 is formed over the battery receptacle 27 and houses a motor 32. The output shaft 33 of the motor 32 rotates an eccentrically mounted disk 34. Rotation of the eccentric disk 34 causes the body 24 and bottom plate 26 to vibrate.

A circuit board 35 is connected to an inner surface of the bottom plate 26 adjacent the frame 31. Referring to FIG. 7, the circuit board 35 includes an oscillator 36 having an amplifier 37 on the input side and an amplifier 38 on the output side. A pair of contacts 39 and 40 are provided in the bottom plate 26 and are spaced apart as shown in FIG. 6. The contacts 39 and 40 are similar to contacts 21 and 22 of the FIG. 1 embodiment in that they are made of a conductive material and are substantially flush with the bottom of the bottom plate 26 and appear unobtrusively. The contacts 39 and 40 are electrically connected to the circuit but isolated from each other such that the circuit is made open by the contacts with the battery 28 being electrically separated from the remaining circuit.

When the animal toy 23 is placed in the palm of an individual's hand, the contacts 39 and 40 are contacted by the surface of moist skin. The gap between the two contacts 39 and 40 is bridged and the circuit becomes closed. Thus, the contacts 39 and 40 function like a touch sensor in the same way as the FIG. 1 embodiment.

When the circuit is closed by a human hand, the movement mechanism is in the "on" condition. The oscillator 36 intermittently outputs a high frequency level of signals at a predetermined interval. The amplifier 38 which is connected to the oscillator 36 amplifies the signal being output by the oscillator 36. The motor 32 is thus driven according to the signals output by the oscillator 36. When the contacts 39 and 40 are bridged by the palm of an individual's hand, and current is supplied to the circuit by the battery 28, the eccentrically mounted disk 34 rotates so as to cause the animal toy 23 to vibrate as if it were alive. The vibration creates a "quivering" movement which renders the animal toy 28 life-like. The contacts 39 and 40 eliminate the need for protrusive switches or knobs, and thus, the absence of protrusive switches furthers the life-like appearance of the animal toy.

The photosensor 17 shown in FIG. 3 can be replaced by other variable resistance sensors such as a temperature sensor whose resistance varies in accordance with the presence or absence of a human hand. The movement mechanism, rather than an eccentric disk and motor, could be any electrically powered movement mechanism. The contacts used in both preferred embodiments could be used as a switch for any animal toy or other toy suitable for handling in the palm of a hand.

Numerous modifications and adaptations of the animal toy of the present invention will be apparent to those so skilled in the art and thus, it is intended by the following claims to cover all such modifications and adaptations which fall within the true spirit and scope of the invention.

What is claimed is:

1. An animal toy comprising:

a body shaped in the shape of an animal and having inner and outer surfaces;

means for moving the body;

an electrical motor attached to the moving means for actuating the moving means;

a control circuit electrically coupled to the electrical motor;

a pair of spaced apart contacts electrically connected tot he control circuit but isolated from each other;

the control circuit being closable to switch on the electrical motor when the pair of spaced apart electrical contacts are simultaneously touched by a human hand, wherein the body comprises an upper body shell having an open bottom, and a bottom plate receivable int he open bottom of the upper body shell, the pair of spaced apart contacts being mounted in the bottom plate.

2. An animal toy as recited in claim 1, wherein the moving means comprises an eccentrically mounted disk connected to the electrical motor.

3. An animal toy as recited in claim 1, wherein the control circuit includes a battery power source, an oscillator, an oscillator input amplifier, and an oscillator output amplifier.

4. An animal toy as recited in claim 1, wherein the bottom plate includes a battery receptacle and a frame for housing the electrical motor.

5. An animal toy as recited in claim 1, wherein the body is in the shape of a mouse.

* * * * *